US005944400A

United States Patent [19]

Fulterer

[11] Patent Number: 5,944,400

[45] **Date of Patent: *Aug. 31, 1999**

[54] TELESCOPIC SLIDE ASSEMBLY FOR A PULLOUT TALL CUPBOARD

[75] Inventor: Manfred Fulterer, Lustenau, Austria

[73] Assignee: Fulterer Gesellscaft m.b.H., Lustenau, Australia

[ * ] Notice: This patent is subject to a terminal disclaimer.

[21] Appl. No.: 08/991,243

[22] Filed: Dec. 16, 1997

[30] Foreign Application Priority Data

Dec. 17, 1996 [AT] Austria ..... A-2199/96

[51] Int. Cl.[6] ..... A47B 88/00

[52] U.S. Cl. ..... 312/334.25; 312/334.29; 312/334.33

[58] Field of Search ..... 312/334.23, 334.24, 312/334.25, 334.26, 334.27, 334.28, 334.29, 334.31, 334.32, 334.33, 334.39, 334.41, 334.8, 334.9, 334.12, 334.15, 334.18; 384/19

[56] References Cited

U.S. PATENT DOCUMENTS

| | | | |
|---|---|---|---|
| 1,095,363 | 5/1914 | Weiss | 312/334.33 |
| 3,450,446 | 6/1969 | Fall et al. . | |
| 5,275,483 | 1/1994 | Rasmussen | 312/334.27 X |
| 5,417,490 | 5/1995 | Hobbs et al. . | |

*Primary Examiner*—Peter M. Cuomo
*Assistant Examiner*—Karlena D. Schwing
*Attorney, Agent, or Firm*—Anderson, Kill & Olick, P.C.

[57] ABSTRACT

A telescopic slide assembly for a pullout tall cupboard and including U-shaped stationary and displaceable rails attachable, respectively, to an element of the cupboard unit and a bottom side of the pullout cupboard, with the displaceable rail arranged telescopically within the stationary rail in a nested relationship, and with stationary and displaceable rails having, respectively, support and running rollers provided, respectively, in the front region of the stationary rail and the rear region of the displaceable rail and projecting, respectively, beyond the upper edges of the cheeks of the stationary rail and beyond the foot web of the displaceable rail.

9 Claims, 3 Drawing Sheets

B
H

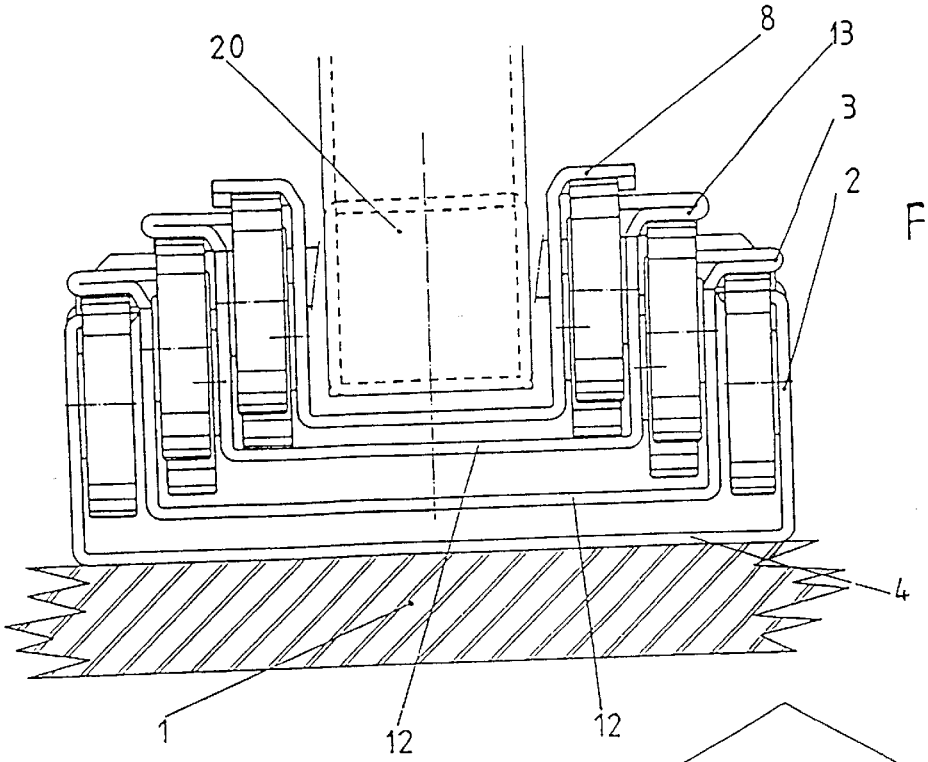
Fig. 9
Fig. 10
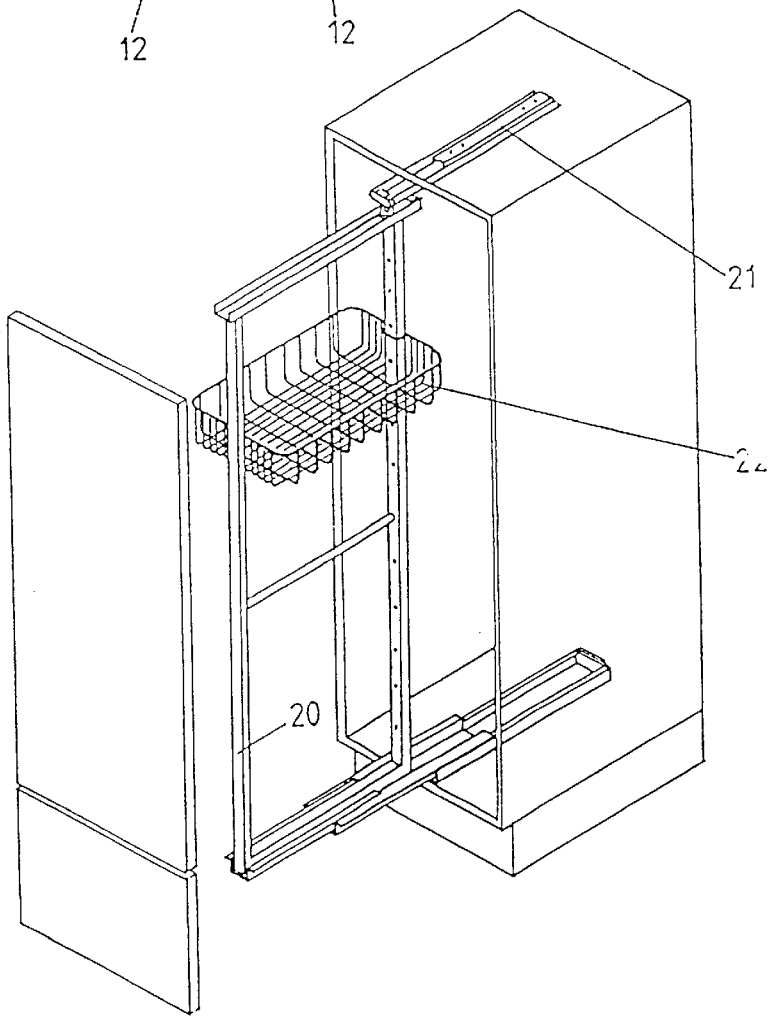

TELESCOPIC SLIDE ASSEMBLY FOR A PULLOUT TALL CUPBOARD

BACKGROUND OF THE INVENTION

1. Field of the Invention

The present invention relates to a pull out assembly for a pullout tall cupboard and including a plurality of U-shaped rails displaceable relative to each other and formed of a sheet-metal strip material, with at least one rail having freely rotatable running and/or support rollers, with one of the rails being secured to a cupboard unit and another rail being secured to a bottom side of the pullout tall cupboard, and with the rail secured to the cupboard unit having a width larger than that of the rail secured to the pullout cupboard.

2. Description of the Prior Art

A pullout assembly for a tall cupboard is disclosed in Austrian Patent NO. 285,099. This assembly includes two C-shaped rails arranged one above the other, with the open sides of both rail facing each other. The height of this assembly is equal to the sum of both rails with the vertical spacing between the two rails being predetermined in advance. In this assembly, the diameter of the running rollers corresponds to the height of the rails. These rollers cannot be made sufficiently small, as they should carry an increased load. This pullout assembly is formed as a differential drawer. The running rollers are provided on rail located between the two C-shaped rails facing each other.

Another type of pullout assembly for a tall cupboard is disclosed in German Publication DE-OS 42 24 281. It includes a carcass rail formed of two identical U-shaped rails having their base webs spaced from each other and extending parallel to the middle or central plane of the cupboard pull-out, and a extendable or displaceable U-shaped rail which is connected with the cupboard, overlaps the carcass rail, is supported on the carcass rail by rollers, and has an incoming inclination. At that, a telescopic rail is arranged in a channel formed between the base webs of the rails forming the carcass rail. The telescopic rail has sidewise projecting upper and lower legs. The telescopic rail is supported on the carcass rail by rollers which engage the legs. At its outer end, the telescopic rail has rollers which cooperate with the incoming inclination of the extendable rail for supporting the same. At least one driver member is provided between the extendable and telescopic rails which provides for limited connections of the rails along a portion of the withdrawl and/or retracted stroke. This pullout assembly is very expensive. The advantage of the pullout assembly described in this German publication in comparison with that of the Austrian Patent NO. 285,099 consists in that it has a relatively small height.

There exist also pullout assemblies for tall cupboards built on so-called differentiated principle, which are designated for a permanent market. This assembly includes a U-shaped stationary rail securable to a furniture unit, an intermediate differential rail provided with running and support rollers, and another rail fixedly securable to an underside of a cupboard and the horizontal flanges of which are supported by rollers of the differential rail. The height of such differential pullout assembly can be very large. Therefore, the running rollers should have a relatively small diameter because in this type of a pullout assembly the running rollers should be arranged immediately one above the other. With these differential pullout assemblies, for complete withdrawal from the unit, the load should be somewhat lifted, because in the differential pullout assemblies, the running rollers are supported with some backlash. This adversely affects the serviceability of such assemblies, as these assemblies are sometimes used for tall cupboard carrying rather heavy loads.

U.S. Pat. No. 5,417,490 describes a pullout slide assembly for a tall cupboard formed of three rails. The rail, which is fixedly attached to a cupboard unit, has a U-shaped cross-section with inwardly directed flanges. The rail, which is attached to the pullout element, has an I-shaped cross-section and is formed of two profile members the upper horizontal flange of which is noticeably wider than the lower flange. The intermediate rail has a U-shaped cross-section having its upper flanges extending outwardly. The extendable I-shaped rail does not carry any support and running rollers. Rather, it is carried by support and running rollers provided on the intermediate rail. In this assembly, the intermediate rail is supported by rollers of the stationary rail which engage the outwardly extending flanges.

Finally, U.S. Pat. No. 3,450,446 discloses a drawer guide which is formed of drawn of rolled rails which have no support or running rollers but are provided only with rolling bodies mounted in a cage. Because of high costs associated with manufacturing of such assemblies, they did not find practical application.

Accordingly, an object of the present invention is to provide a pullout slide assembly for tall cupboards having a smallest height possible and convenient in exploitation.

Another object of the present invention is to provide a pullout slide assembly which can expand on the basis of a building block principle to achieve a maximum possible pullout length.

SUMMARY OF THE INVENTION

These and other objects of the present invention, which will become apparent hereinafter, are achieved by providing a telescopic slide assembly for a pullout tall cupboard and which includes a stationary U-shaped rail formed of a sheet-metal strip, securable to an element of a cupboard unit and having a plurality of support rollers provided in the front end region of the stationary rail, with the support rollers projecting above upper edges of cheeks of the stationary rail, and a displaceable U-shaped rail likewise formed of a sheet metal strip, fixedly securable to a bottom side of a pullout tall cupboard and having a plurality of running rollers provided in a rear region of the displaceable rail and mounted on outer sides of respective checks of the displaceable rail, with the running rollers projecting beneath a foot web of the displaceable rail, and with the displaceable rail being telescopically received within the stationary rail in a nested relationship.

One of the many advantages of the telescopic slide assembly according to the present invention consists in its relatively small height. Another advantage consists in that it can be expanded based on the building block principle. Yet a further advantage of the inventive assembly consists in that it can be formed of one and the same type of rails. In the inventive assembly, an arbitrary number of intermediate rails can be used with all of the intermediate rails having the same construction and having the same arrangement of support and running rollers which are identical. Thereby, an arbitrary large pullout length can be achieved with relatively small manufacturing costs. Thus, the intermediate rollers all would have the same cross-section, the same shape flanges and the same arrangement of rollers, with only widths of the intermediate rails being different.

BRIEF DESCRIPTION OF THE DRAWINGS

The features and objects of the present invention will become more apparent, and the invention itself will be best understood from the following detailed description of the preferred embodiments of the present invention when read with reference to the accompanying drawings, wherein:

FIG. 9 shows a view similar to that of FIG. 7 but with two intermediate rails; and FIG. 10 shows a schematic perspective view of the telescopical slide assembly according to the present invention.

DETAILED DESCRIPTION OF THE PREFERRED EMBODIMENT

Figures 1, 2, 3, 4, 5, 6:
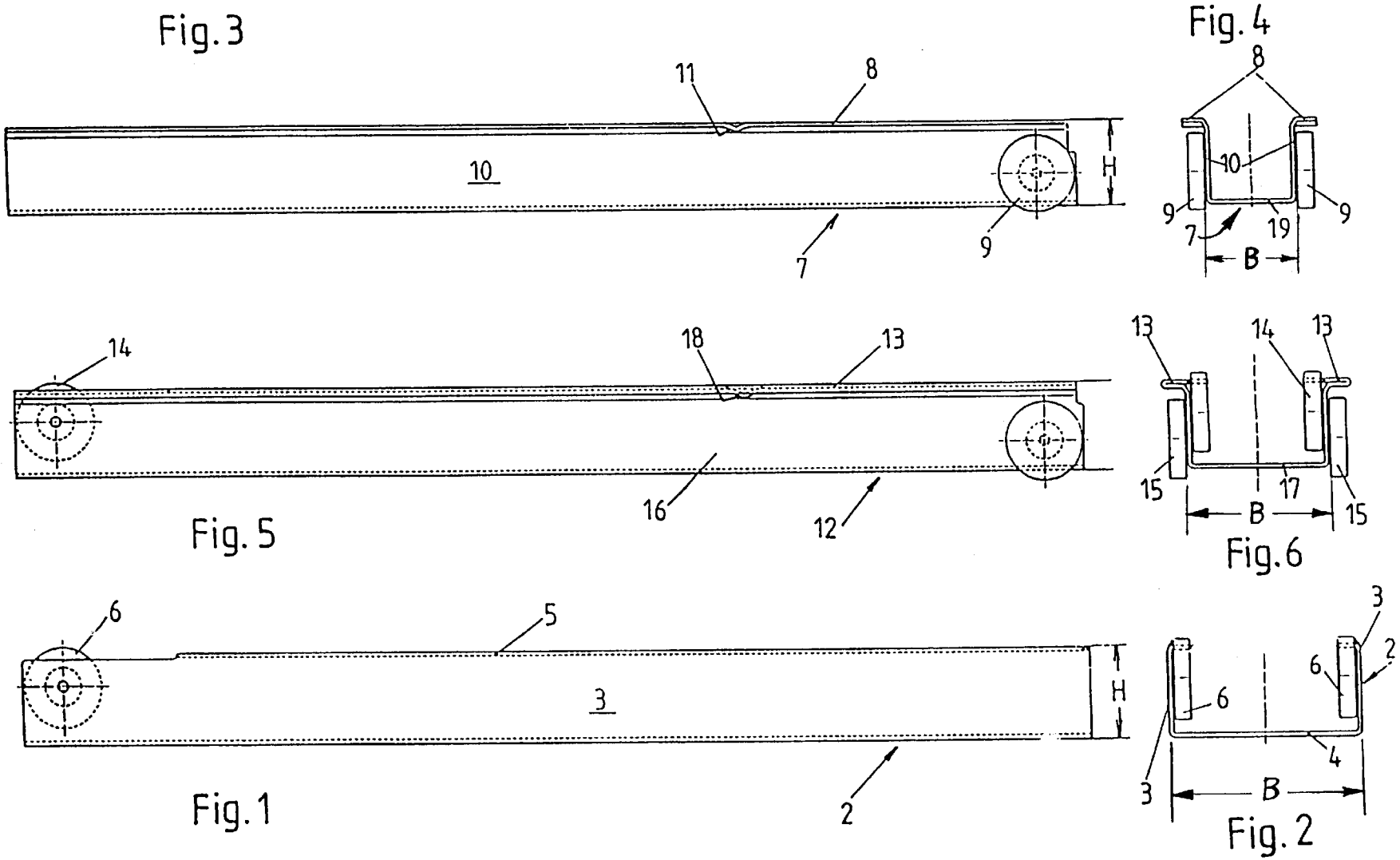
FIG. 1 shows a side view of a stationary rail of a telescopic slide assembly for a tall cupboard according to the present invention.
FIG. 2 shows a front elevational view of the rail shown in FIG. 1.
FIG. 3 shows a side view of an extendable rail of a telescopic slide assembly for a tall cupboard according to the present invention.
FIG. 4 shows a front elevational view of the rail shown in FIG. 3.
FIG. 5 shows a side view of an intermediate rail of a telescopic slide assembly for a tall cupboard according to the present invention.
FIG. 6 shows a front elevational view of the rail shown in FIG. 5.

A stationary rail 2 of a telescopic slide assembly according to the present invention, which is secured to a furniture member 1, has a U-shaped cross-section with two side cheeks 3 and a foot web 4 connecting the two side cheeks 3. Upper edges of the side cheeks 3 are bent inwardly toward the middle plane of the rail 2, forming horizontal flanges 5. At the front end of the rail 2, the flanges 5 have a cut-out, and freely rotatable support rollers 6 are located in the cut-outs of the horizontal flanges 5. The support rollers 6, as shown in FIGS. 1–2, project somewhat above the horizontal flanges 5. The support rollers 6, as shown, are provided on the inner side of the side cheeks 3. When a reference to a plurality of rollers is made, here and elsewhere, it means that in the cross-sectional plane of a rail, there is a pair of rollers 6 is provided (see FIG. 2).

An extendable or displaceable rail 7, which is shown in FIGS. 3–4 likewise has a U-shaped cross-section, but horizontal flanges 8 of the rail 7 are bent outwardly. The rail 7 has, in its rear region, freely rotatable running rollers 9, which are provided on the outer sides of the cheeks 10 of the rail 7. An inwardly directed dent-shaped deflection 11, which is formed on the horizontal flanges 8 of the rail 7 serves as a stop, limiting withdrawal of the cupboard. The rail 7 is connected to the bottom side of the extendable tall cupboard.

The intermediate rail 12 also has a U-shaped profile and has, at the upper edges of its cheeks 16, T-shaped horizontal flanges 13, having portions directed outwardly and portions directed inwardly. At the front region, the intermediate rail 12 is provided with a pair of support rollers 14 which are mounted on inner tides of respective cheeks 16 of the rail 12. The support rollers 14, as shown in FIGS. 5–6, project somewhat above the T-shaped horizontal flanges 13. In the near region of the intermediate rail 12, there are provided running rollers 15 which are mounted on outer tides of the side cheeks 16. The running rollers 15, as shown in the drawings, project somewhat below the foot web 17 of the intermediate rail 12. The outwardly directed portions of the T-shaped flanges 13 are also provided with a dent-shaped deflection 18 which forms a stop, limitting withdrawal of the tall cupboard.

Figure 7:
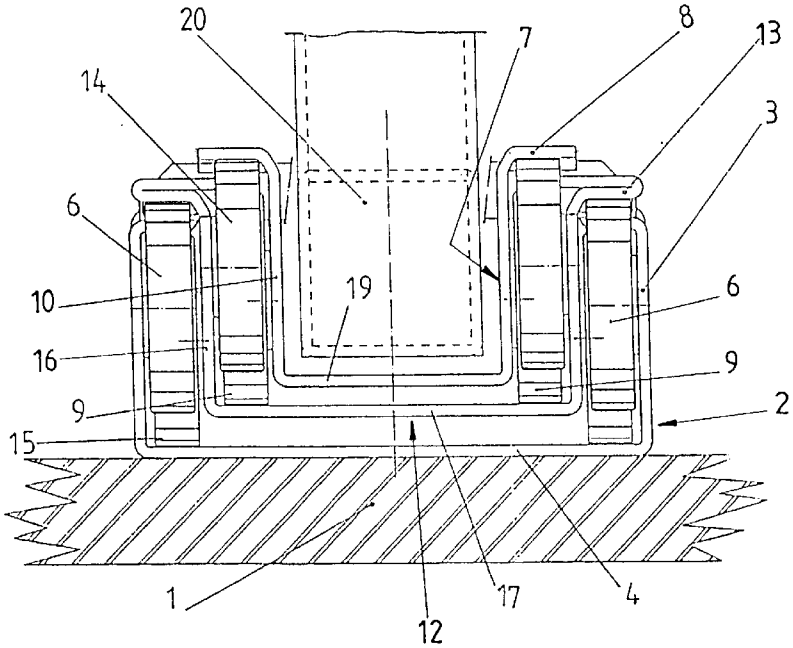
FIG. 7 shows a front elevational view of the rails shown in FIGS. 1–6 in an assembled condition, together with a frame for a tall cupboard.

All of the rails 2, 7 and 12 have approximately the same height. The diameter of the support and running rollers can also be the same. However, the widths B, B' and B" of the rails 2, 7 and 12 are different, and are so selected that the rails 2, 7, 12 are telescopically arranged within each other, as can be seen in FIGS. 7 and 9. The open sides of all of the rails 2, 7, 12 are directed upwardly, and the foot webs 4, 17, 19 of the rails 2, 7, and 12 are arranged adjacent to each other one above another, with a small distance therebetween. The vertical distances between two adjacent foot webs are substantially the same and amount to about 2/10 of the height H.

Figure 8:
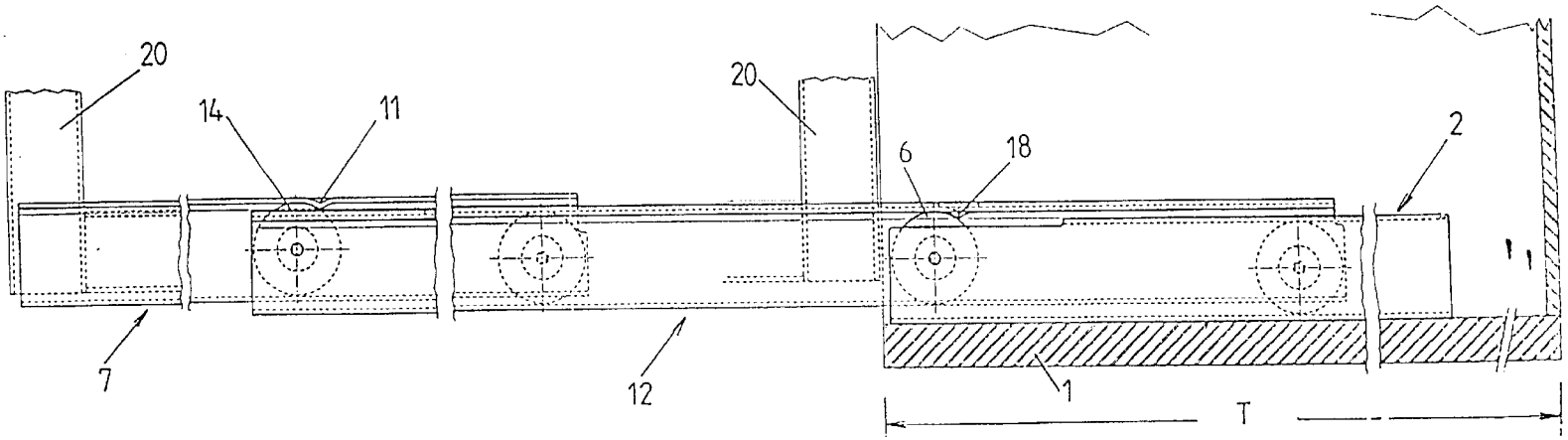
FIG. 8 shows a side view of the assembly shown in FIG. 7 in a pull-out condition.

The slide assembly, as shown in FIGS. 7–8, is a telescopical assembly. In the open space of the uppermost, extendable rail 7, a carrier frame 20 of a tall cupboard can be mounted. The frame 20 is circumferentially closed and is formed of sectional frames. Carrier baskets 22 can be suspended directly on vertical sections of the carrier frame 20. Alternatively, the vertical sections of the frame 20 can support elements of a tall cupboard. The arrangement of the basket 22 on the carrier frame 20 is shown in FIG. 10. As shown in FIG. 10, the upper element of the tall cupboard is provided with a guide 21.

As shown in FIG. 8, the length of the slide assembly need not correspond to the depth T of a tall cupboard to insure a complete withdrawal i.e., a withdrawal at which the back side of the withdrawn component is in front of the end surface of the cupboard or furniture element.

The slide assembly shown in FIGS. 7–8 is formed of three rails 2, 7, 12. However, a number of intermediate rails can be increased, as shown in FIG. 9. In the embodiment shown in FIG. 9, there are provided two intermediate rails 12, with both rails 12 having the same construction. However, the widths of the intermediate rails 12 shown in FIG. 9 differ to provide for their telescopic mounting one within the other.

If the withdrawn cupboard unit component has a bottom plate, it can be mounted on the upper surface of the horizontal flanges 8 of the upper extendable rail 7. As further can be seen from the drawings, the use of rails having a greater height does not significantly increases the height of the entire assembly. Further, the diameter of the support and running rollers substantially corresponds to the inner height of the rail. In the embodiments shown in the drawings, the assembly has three rails (FIG. 7) or four rails (FIG. 9). However, it is possible to provide slide assemblies having only two of the rails 2 and 7, only a stationary rail and an extendable rail. In this case, however, a complete withdrawal is not possible.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A telescopic slide assembly for a pullout tall cupboard, comprising:

a stationary U-shaped rail having two side cheeks and a foot web connecting the two side cheeks and formed of a sheet metal strip, the stationary rail being securable to an element of a cupboard unit and provided with a plurality of support rollers arranged in a front end region of the stationary rail, the support rollers projecting above edges of the side cheeks of the stationary rail, a displaceable U-shaped rail having two side cheeks and a foot web connecting the two side cheeks and formed of a sheet metal strip, the displaceable rail being fixedly securable to a bottom side of the pullout tall cupboard and provided with a plurality of running rollers arranged in a rear region of the displaceable rail and mounted on outer sides of respective cheeks of the displaceable rail, the running rollers projecting beneath the foot web of the displaceable rail, the displaceable rail being telescopically arranged within the stationary rail in a nested relationship therewith; and an intermediate U-shaped rail having two side cheeks and a foot web connecting the two side cheeks and arranged between the stationary and displaceable rails, the intermediate rail having T-shaped horizontal flanges, which are formed by upper edges of the side cheeks thereof and which extend inwardly and outwardly, the intermediate rail having a plurality of support rollers provided in a front region of the intermediate rail which project above respective T-shaped flanges of the intermediate rail, and a plurality of running rollers provided in a rear region of the intermediate rail which project beneath the foot web of the intermediate rail.

2. An assembly as set forth in claim 1, wherein the support rollers are mounted on inner sides of the side cheeks of the stationary rail.

3. An assembly as set forth in claim 1, wherein horizontal flanges, which are formed by sidewise projecting edges of the side cheeks of the stationary rail are directed toward each other, and wherein horizontal flanges, which are formed by the sidewise projecting cheeks of the displaceable rail are directed outwardly.

4. An assembly as set forth in claim 1, wherein the support and running rollers have a diameter corresponding approximately to an inner height of the U-shaped stationary and displaceable rails.

5. An assembly as set forth in claim 1, wherein the support rollers are provided on inner sides and the running rollers are provided on outer sides of respective cheeks of the intermediate rail.

6. An assembly as set forth in claim 1, wherein the stationary, intermediate and displaceable rails have substantially a same height.

7. An assembly as set forth in claim 1, further comprising a plurality of intermediate rails having a same construction.

8. An assembly as set forth in claim 1, wherein a distance between the foot webs of the stationary and intermediate rails is substantially equal to a distance between feet webs of the intermediate and displaceable rails.

9. An assembly as set forth in claim 1, wherein the stationary, intermediate and displaceable rails have substantially the same height, and wherein a vertical spacing between adjacent foot webs is equal to about two/tenth of the rail height.

* * * * *